United States Patent [19]

Lutz

[11] 3,979,831

[45] Sept. 14, 1976

[54] METHOD AND APPARATUS FOR ALTERING CLOTHING PATTERNS

[76] Inventor: Helene P. Lutz, 120 E. Market St., Rhinebeck, N.Y. 12572

[22] Filed: Nov. 22, 1974

[21] Appl. No.: 526,440

[52] U.S. Cl. ..... 33/17 R; 33/11

[51] Int. Cl.[2] ..... A41H 3/00

[58] Field of Search ..... 33/12, 15, 16, 17 R

[56] References Cited

UNITED STATES PATENTS

| | | | |
|---|---|---|---|
| 389,287 | 9/1888 | Christner | 33/17 R |
| 633,654 | 9/1899 | Melick | 33/15 |
| 711,479 | 10/1902 | Curran | 33/17 R |
| 2,762,124 | 9/1956 | D'Angelo | 33/16 |

OTHER PUBLICATIONS

"Pattern Alteration" U. S. Dept. of Agriculture, Farmers Bulletin, No. 1968, pp. 4, 5, 14 and 15.

*Primary Examiner*—Charles E. Phillips
*Attorney, Agent, or Firm*—Pollock, Vande Sande & Priddy

[57] ABSTRACT

A method and apparatus for altering conventional clothing patterns are disclosed in which a series of measurements taken on a particular individual are used to construct alteration lines on a pattern which facilitate revision of the pattern to produce a garment particularly well fitted to the individual. Most body measurements taken on the individual are measured, directly or indirectly, from the point at which the arm joins the body at the underarm, thereby providing proper placement of armhole openings and appropriate shoulder slope to accomodate the individual's figure. A unique measuring template for facilitating measurements on the individual is also disclosed.

3 Claims, 9 Drawing Figures

METHOD AND APPARATUS FOR ALTERING CLOTHING PATTERNS

BACKGROUND OF THE INVENTION

Commercially available patterns used in the home for making clothing such as dresses and suits are conventionally available in a variety of sizes chosen to accomodate normal or average combinations of height, weight, musculature, bone structure and related factors. If the individual for whom a particular garment is to be made from a commercially available pattern has an unusual figure including one or more features such as markedly rounded shoulders, large bustline, one shoulder higher than the other, humped back and similar variations from the average figure, then either the commercially available pattern must be altered to account for such differences or the garment made from the commercially available pattern must be altered for the same purpose.

The prior art teaches numerous methods and apparatus for altering garment patterns to accomodate variations in an individual figure from the average figures for which the patterns are made. A difficulty with the prior art solutions is that while numerous methods have been derived for correcting a pattern for a particular figure variation, the correction for one particular variation may result in a need for correction to other portions of the pattern which, once corrected, may result in further need for correction to still other portions of the pattern, and so on. This considerably complicates the task facing the home sewer or tailor when confronted with an unusual figure to be fitted.

It is an object of this invention to provide a method and apparatus for altering garment patterns which inherently account for numerous figure variations on each individual and enable the home sewer or tailor to modify a particular pattern style prior to cutting any fabric with reasonable assurance that the fabric as cut will produce a garment of proper fit.

A further object of this invention is to provide a method and apparatus for altering garment patterns which may be applied to a variety of garment styles to produce altered patterns fitted to the proportions of various individuals.

Another object of this invention is to provide a method and apparatus for altering garment patterns such that the altered patterns will yield an essentially perfect fit in the neck, shoulder and armhole areas, as well as the correct bodice or trunk length of fitted garments having set in sleeves.

SUMMARY OF THE INVENTION

To accomplish the above and other objects of the invention, the method disclosed comprises the steps of measuring certain body dimensions on the individual for whom a garment is to be made and relating the individual measurements to the point on the individual at which the arm joins the body at the underarm. The various measurements taken on the individual's body are then transferred in a unique manner to a commercially available pattern in the desired style and the pattern is altered both in length and in circumference to approximate the actual dimensions of the individual, plus allowances for ease. Using additional dimensions measured on the individual, the pattern is further altered by constructing lines thereon which accurately locate the proper points for placement of armholes and the proper shoulder slope angle for the particular individual. A measuring template is provided to facilitate relation of the various measurements to the point at which the arm joins the body at the underarm.

DESCRIPTION OF THE PREFERRED EMBODIMENTS

Figure 1:
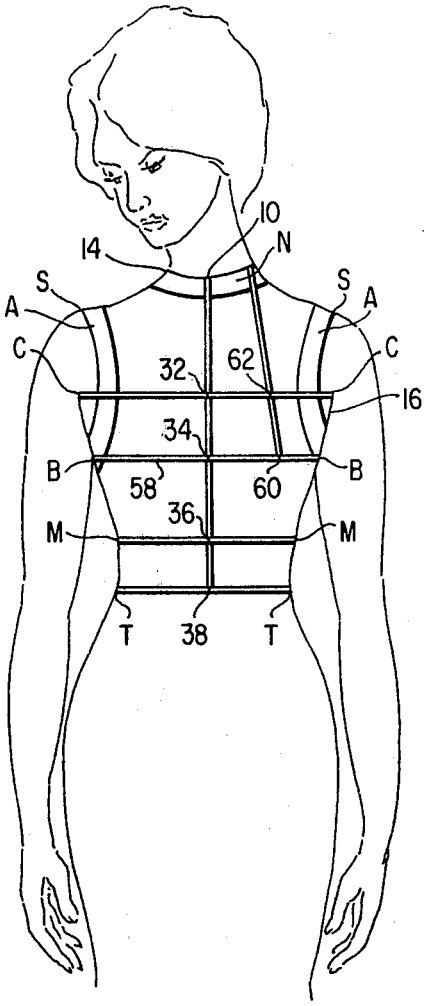
FIG. 1 shows a schematic illustration of the frontal aspect of an individual to be fitted for a garment, indicating the various measurements to be taken.

There follows a detailed description of the preferred embodiments of the invention, reference being had to the drawings in which like reference numerals or letters identify like elements of structure in each of the several figures.

Figure 2:
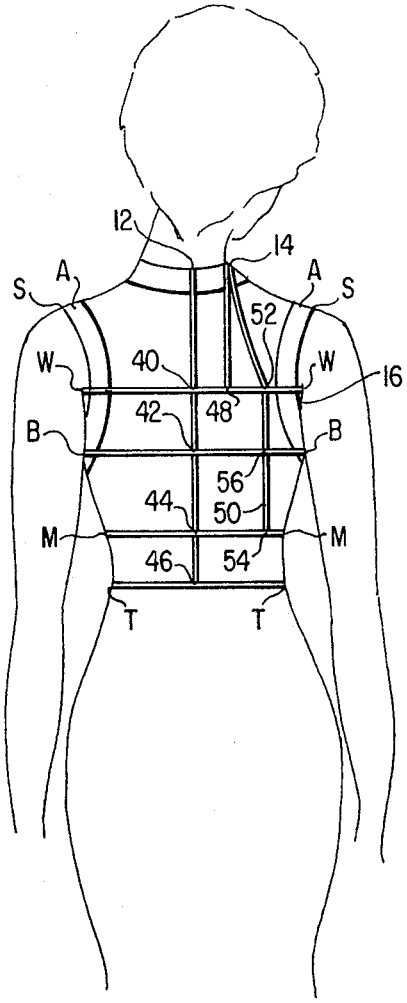
FIG. 2 shows a schematic representation of the rear aspect of an individual to be fitted for a garment, indicating the various measurements to be taken.

Referring to FIGS. 1 and 2, schematic illustrations of the frontal and rear aspects of an individual to be fitted are shown. Ordinarily, the individual is measured for pattern alteration with shoes and foundation garments in place. Measurements are taken around the midriff M-M, at the lower portion of the rib cage or diaphragm area of the lower chest; at the chest or bustline B-B and at the waistline T-T, keeping the measuring tapes parallel to the floor at all times. To facilitate the various measurements required, it is convenient to attach tapes or similar markers to the individual at each of these desired locations. In the example of the method of the invention illustrated, the individual is a female and the garment for which the individual is to be fitted is a bodice front dress. It will be understood, however, that the basic method according to the invention may be applied to related clothing patterns for males, without departing from the spirit of the invention.

A plurality of neckline templates N are cut and sewn in varying sizes from pellon fabric of approximately a one inch width, using the neckline configuration of the basic pattern to be altered. From among these templates, one is chosen which has the desired fit for the individual. This template is then placed on the individual as it would be worn in the basic garment and may be pinned to the individual's foundation garments, if possible. Base points of neckline template N at the center front 10, center back 12 and neckline at shoulder joining point 14 are then marked directly on the individual, with neckline template N arranged as the garment should fall when worn. The particular neckline template generally sets the basic pattern size to be altered for the individual, assuming an average figure.

Point 16 identifies the location at which the arm joins the body at the underarm when the arm is hanging at the individual's side, hereinafter referred to as the arm-cross point, which is a reference point for subsequent measurements and pattern alterations. A plurality of pellon armhole templates A are cut and sewn in varying sizes for each arm, including the appropriate shoulder and side seams as called for on the basic pattern. From among these armhole templates A, one is chosen for each arm which falls a short distance, usually about one inch, below the arm-cross point 16 when the arm is resting at the individual's side. The armhole template A is placed on each arm as it would be worn in the basic garment and may be pinned to the foundation garments. When armhole template A is placed on the individual, its underarm seamline is positioned perpendicular to the floor and the individual is marked at the shoulder point S where the shoulder seam of the armhole template A falls when the outer edge of the armhole template A is placed a short distance, usually one quarter of an inch, in from the outer edge of the arm. When the pattern itself is altered, corresponding tissue paper templates of the same size are to be used to duplicate the pellon template for each arm and the neckline.

Figure 4:
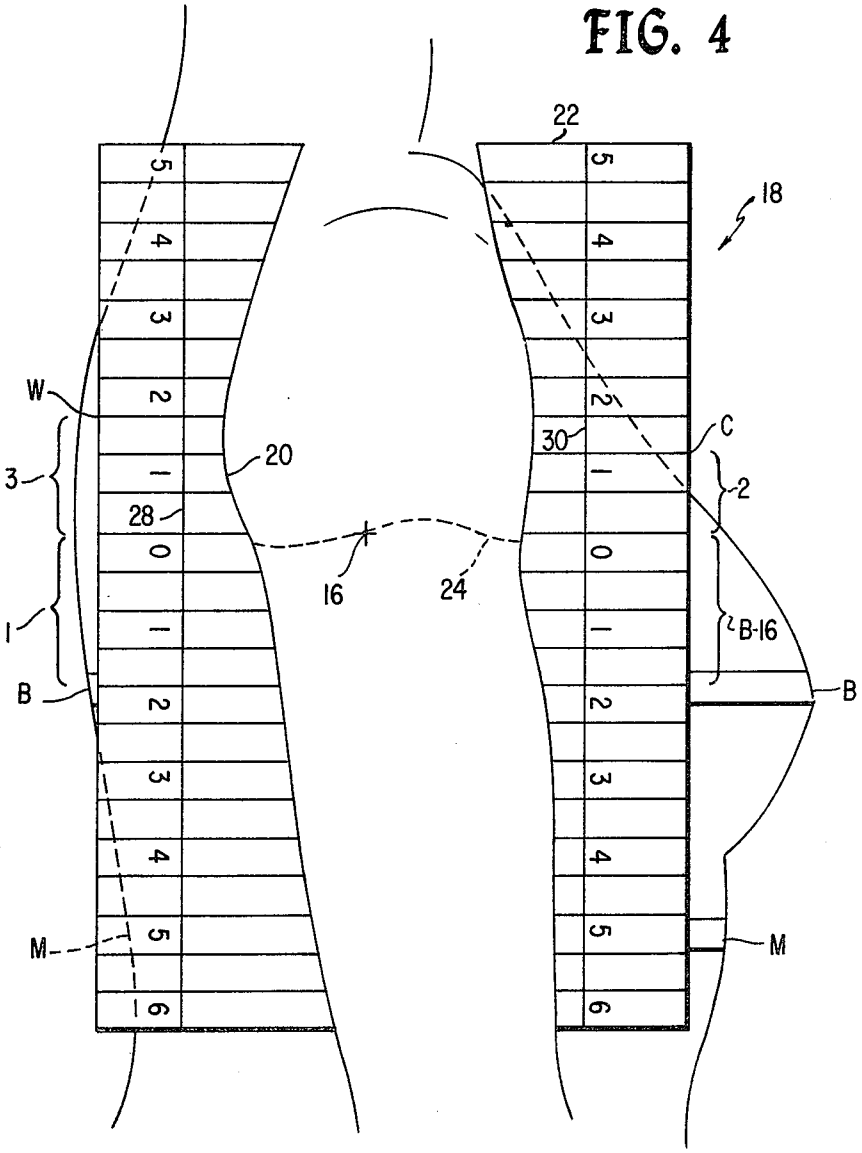
FIG. 4 shows a view of the measuring template according to the invention in actual use on an individual to be measured.
Figure 3:
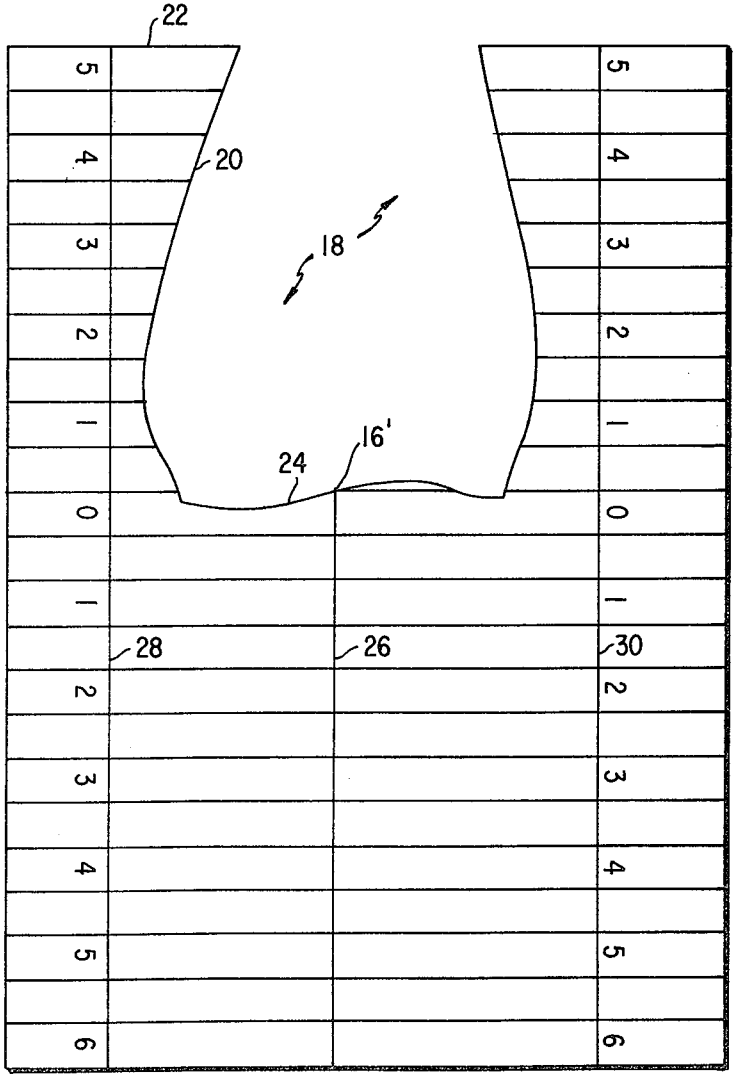
FIG. 3 shows the unique measuring template of the invention.

Referring briefly to FIGS. 3 and 4, the arm-cross measuring template 18 of the invention may be understood. Template 18 is a wide, flat measuring ruler comprised of an elongated blank of suitable material such as plastic or heavy cardboard having a deep, open curve 20 cut away along the upper edge 22 thereof. Open curve 20 approximates the depth of the arm to shoulder joint and the contour of the underarm or armpit when the arm is resting at the side. The lower surface 24 of open curve 20 is shaped to fit into the underarm or armpit easily at the arm-cross point 16. Point 16' on surface 24 is located at the point where a garment side seam would touch arm-cross point 16. Measuring template 18 includes on either side thereof, a plurality of scales 26, 28 and 30 which extend above and below a horizontal origin line drawn through the arm-cross point 16' of the template and marked 0 on the template, as shown. Scale 28 facilitates measurements at the individual's back, relative to the arm-cross point; scale 26, at the side-seam location; and scale 30, at the individual's front. As shown in FIG. 4, template 18 is inserted between the body and arm of the individual so that the arm-cross of the individual contacts lower surface 24 of the template and point 16' is located at the arm-cross. Thus, various measurements may be made relative to the location of arm-cross point 16. After the distance M-B from the midriff contour M-M to the chest or bustline contour B-B of the individual has been measured at the side-seam on scale 26, measuring template 18 is used to measure the distances from the chest or bustline contour B-B to the arm-cross point 16 and from the arm-cross point 16 to the upper chest contour C-C and the upper back width contour W-W. The end points of upper chest contour C-C and the upper back width contour W-W are determined by the upper ends of the lines formed by the folds of flesh which appear at the front and back just above the arm-cross point when the arm is resting at the individual's side. The contours C-C and W-W also are taped on the individual parallel to the floor, insofar as possible.

Referring again to FIGS. 1 and 2, the individual is measured along the body surface at the center front from the front neckline base point 10 to the center 32 of upper chest contour C-C; from center 32 to the center 34 of bust or chest contour B-B; from the center 34 to the center 36 of midriff contour M-M; from the center 36 to the center 38 of waist contour T-T. At the back, measurements are taken along the center back from the rear neckline base point 12 to center 40 of upper back width contour W-W; from the center 40 to center 42 of chest or bust contour B-B; from the center 42 to the center 44 of midriff contour M-M and from center 44 to the center 46 of waist contour T-T.

Continuing at the back of the individual, measurements are taken from the neckline at shoulder joining point 14 to point 48 at a location perpendicular to the upper back width contour W-W and from point 48 to point 40, perpendicular to the center back of the individual. At bustline contour B-B, a line 50, parallel to the center back of the individual, is marked at a point approximately on the location where a dart would appear on a conventional pattern, or mid-way between the individual's center back and the location of a conventional side-seam under the individual's arm. An upward extension of line 50 intersects upper back contour W-W to define the upper side back point 52; whereas, the lower end of line 50 intersects midriff contour line M-M to define lower side back point 54. The individual is then measured from the neck at shoulder joining point 14 to the upper side back point 52 and from point 52 to point 48. The distance on the individual is recorded from point 54 on midriff contour line M-M to point 56 on chest or bustline contour B-B.

Turning to the front of the individual, measurements are taken from the shoulder at neck joining point 14 to the tips 58 and 60 of each breast of the individual and from points 58 and 60 to point 34 on the center front of the individual. At the same time, the distance from shoulder at neck joining point 14 to upper side chest point 62 on the upper chestline contour C-C is measured along the same line from point 14 to points 58 and 60. The distance from points 62 to point 32 is also measured. Finally, the shoulder width is measured between points 8 and 14 and the total length of contour lines C-C and W-W are determined.

Though the discussion thus far has shown measurements being taken on only one side of the individual at the front and back, it will be understood that all measurements are made on both the right and left sides front and back, to account for the non-symmetrical shape of most individuals and ensure proper pattern alteration.

Figure 6:
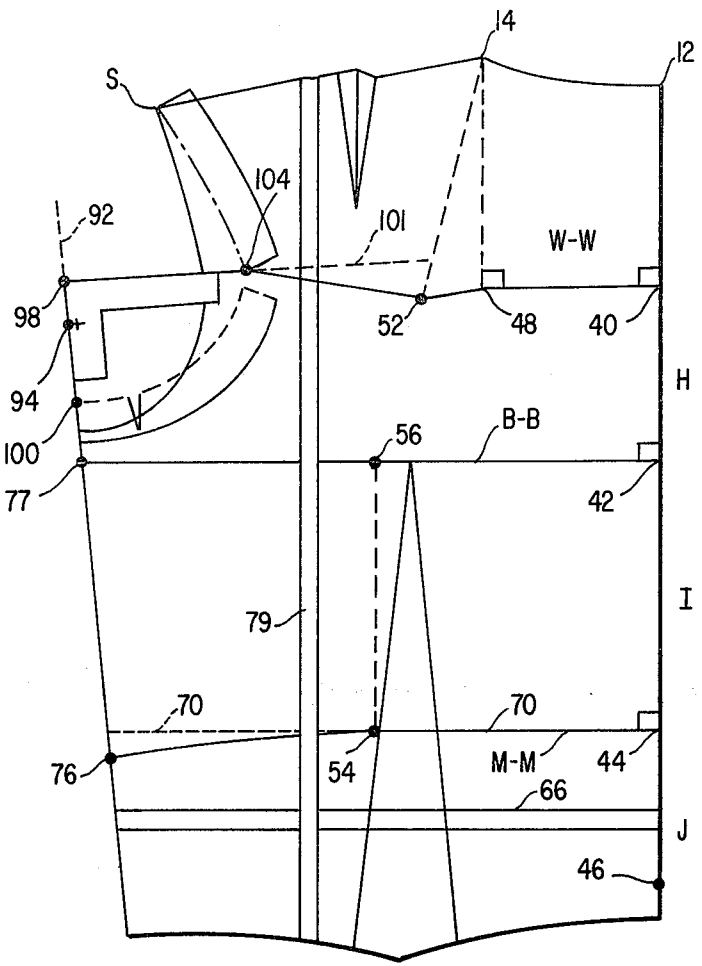
FIG. 6 shows a plan view of a conventional garment pattern for the back of a dress, indicating the various constructions and alterations to be made in accordance with the method of the invention.
Figure 5:
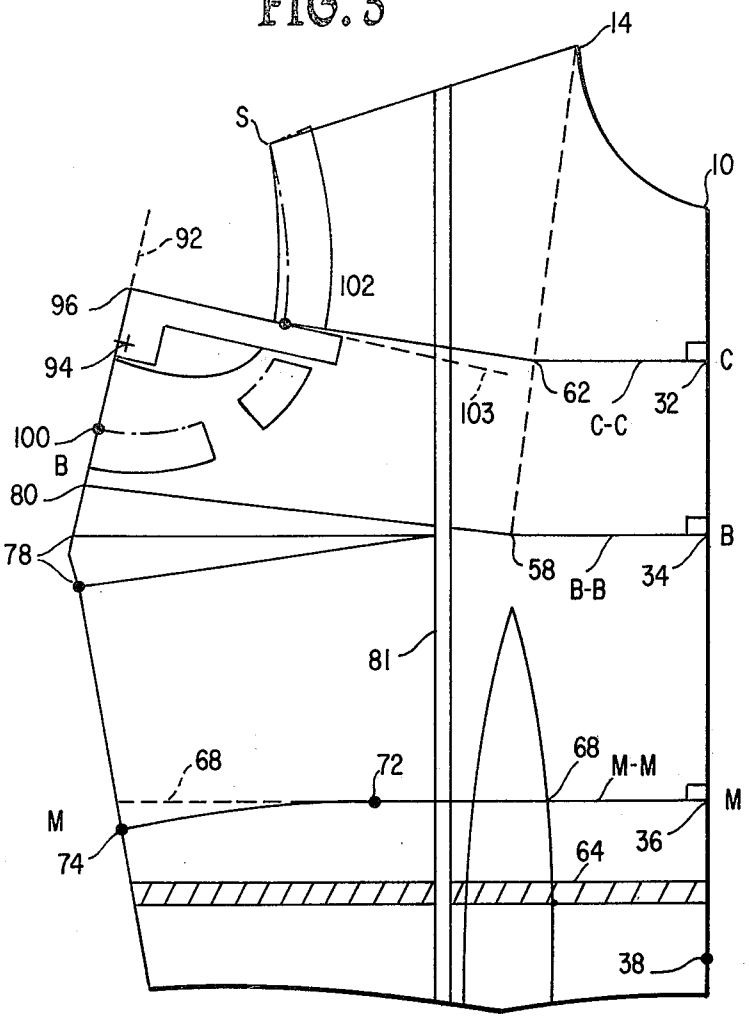
FIG. 5 shows a plan view of a conventional garment pattern for a bodice front dress, indicating the various constructions and alterations to be made in accordance with the method of the invention.

Turning now to FIGS. 5 and 6, the method of altering a garment pattern using the previously described measurements may be understood. The front and back patterns are first marked along their center front and center back to identify points 32, 34, 36 and 38, measuring from the front center of the neckline base downward and points 40, 42, 44 and 46 measuring from the rear center from the neckline base downward. The pattern may require lengthening or shortening between the midriff and waist contours M-M and T-T, as indicated at 64 and 66, to adjust the total length of the front and back center lines of the pattern to equal the corresponding measurements taken on the individual. The length alteration on the front may be different from the back, the difference in the two being accounted for by adjusting the armhole position, as will be discussed.

Following any necessary length adjustments at 64 and 66, midriff contour lines M-M are constructed on the front and back patterns by drawing lines 68 and 70 perpendicular to the center front and center back, respectively, across the patterns from points 36 and 44, as shown. On the pattern front, a point 72 is marked on line 68 at a distance from point 36 corresponding to approximately one half the distance measured on midriff contour M-M from the center front to the side-seam location of the individual, exclusive of any darts shown on the pattern. That is, the width of any dart is not counted in determining the location of point 72. Commencing at point 72, the midriff contour line M-M falls below line 68 in a gentle curve terminating at point 74 a short distance, usually about five-eighths inch, below line 68 at the side-seam location of the pattern. This shape of contour line M-M is necessary to account for the curved shape of the individual's body when transferring measurements to the flat pattern. On the pattern back, lower side point 54 is located on line 70 at a distance spaced from point 44 as previously measured on the individual, exclusive of any darts. As on the pattern front, midriff contour line M-M falls away from line 70 commencing at point 54 in a gentle curve terminating at point 76 on the side-seam location of the pattern, a short distance, usually about one-quarter inch, below line 70. The midriff contour M-M thus acts as a base contour to which other contours on the pattern are related.

The chest or bust contour lines B-B and the upper chest contour lines C-C are now transferred from the individual measurements to the pattern front and back. The distance measured from neckline at shoulder joining point 14 to the bust points 58 and 60 and the distance from bust points 58 and 60 to point 3 are transferred to the pattern so that the line from point 34 to point 58 is perpendicular to the center front and meets the line from point 14 at point 58. Then, the distance measured on the individual from point 32 to point 62 is marked on the pattern as shown. The distance measured on the individual at the side-seam from midriff contour line M-M to the bust contour line B-B is now measured along the side-seam of the pattern starting from point 74 and reaching to point 80, exclusive of any dart. Then, the bust or chest contour line is completed on the pattern from point 58 to point 80.

On the pattern back, a construction line is erected from point 54 parallel to the center back of the pattern as measured between points 54 and 56 on the individual. A line is then drawn from point 42 to point 56 on the pattern. On the side-seam of the pattern, the distance measured on the individual at the side-seam from the midriff contour M-M on the chest or bustline contour B-B is measured from point 76 to point 77, as shown. Points 77 and 56 are joined to complete the chest or bust contour line B-B on the back of the pattern. At this point, both the front and back portions of the pattern are altered as shown at 79 and 81 to conform the total length of the midriff and bust or chest contour lines on the pattern to the actual length of these lines as measured on the individual, plus an allowance for wearing ease.

Figure 7A:
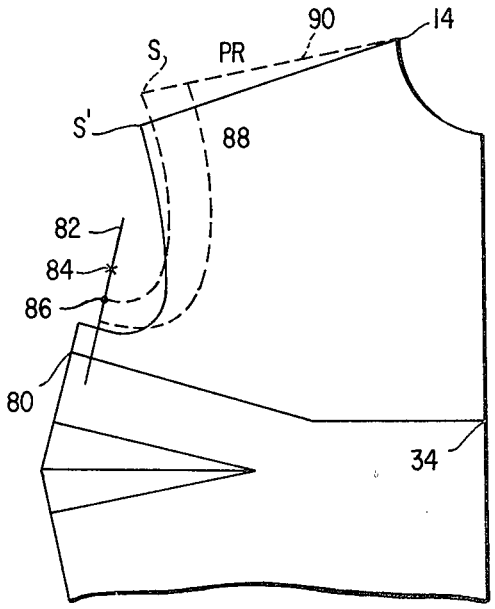
FIGS. 7A and 7B show views of the front of a conventional garment pattern, indicating the constructions and alterations to be made to account for sloped or raised shoulders in accordance with the method of the invention.
Figure 7B:
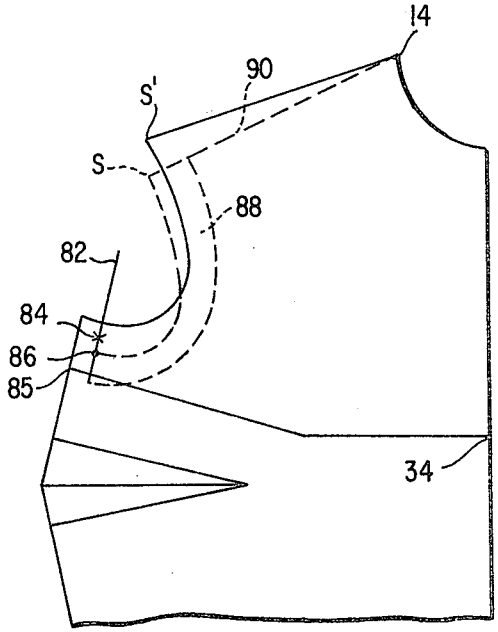

Turning now to FIGS. 7A and 7B, the applicant's unique method of altering a pattern to suit the individual's shoulder slope may be understood. A construction line 82 is drawn parallel to the side-seam of the pattern a short distance in from the side-seam to provide allowance for ease, usually about three-quarters inch. A cross 84 is made on construction line 82 at a distance from bust contour line B-B which corresponds to the arm-cross point measurement made at the side-seam of the individual, as discussed with regard to FIG. 4. Since the shoulders of the individual may vary on each side, it has been found preferable to mark the pattern in distinct colors for the right and left sides of the body. A mark is then placed on construction line 82 at a point 86 approximately one inch below the arm-cross point 84. At this time, tissue paper tracings 88 identical in shape to armhole templates A which were used to measure the individual as discussed with regard to FIGS. 1 and 2 are prepared. Each tissue paper armhole is placed on the pattern with the location of the underarm seamline at point 86 on the front and back and left and right armholes. Without folding or twisting the tissue paper, the entire tissue paper armhole is pivoted about point 86 so that the upper seamline of the armhole is located at a distance from point 14 of the pattern correspondingly to the shoulder width of the individual measured from point 14 to point S on the individual, exclusive of any darts in the pattern. A dashed line 90 is then drawn on the pattern to identify the new shoulder line which corresponds to the individual's actual measurements and conforms the pattern to the individual's particular shoulder slope. FIGS. 7A and 7B illustrate, respectively, situations in which the individuals shoulder is higher and lower than the average shoulder location shown on the pattern.

Returning now to FIGS. 5 and 6, it will be assumed for purposes of further discussion that the shoulder slope of the pattern has been adjusted as shown in FIGS. 7A and 7B. To complete the upper chest and upper back contour lines, additional constructions on the pattern are required. A new construction line 92 is drawn on the pattern as a colinear extension of the pattern side-seam, extending into the armhole area of the pattern. Line 92 is marked according to the distances recorded from the bust contour line B-B to the arm-cross point at point 94 and from the arm-cross point to the upper chest contour line at point 96 and from the arm-cross point to the upper back width contour line at point 98. As previously mentioned, these constructions are made for both the right and left armholes on both the front and back portions of the pattern.

The base of each tissue paper armhole is now placed on construction line 92 at a point 100 located approximately 1½ inches below the arm-cross point 94 to compensate for ease. The upper edge of the armhole must still be aligned with the newly defined shoulder seamline, even if it is necessary to modify the circumferential length of the armhole, such as to slash and spread the tissue paper armhole or fold it over in order to do so. The drawings indicate one type of pattern alteration in which the tissue paper armholes have been cut and spaced as shown to define a new armhole contour on the pattern.

On the pattern back, a construction line is drawn perpendicular to the center back of the pattern at point 40 for a distance equal to the distance measured from point 40 to point 48 on the individual. A construction line from point 14 to point 48 on the pattern is drawn. From point 14 and point 48 are drawn construction lines corresponding to the measurements from these points to point 52 on the individual.

To complete the upper back width and upper chest contour lines, a T square or L square is placed along construction line 92 with the corner of the square at the upper chest contour mark 96 or upper back contour mark 98. Construction lines 101 and 103 are then drawn on the back and front patterns perpendicular to construction lines 92 and extending into the armhole area of the pattern. At this point, the portion of the upper back contour line between points 40 and 52 is measured on the pattern and subtracted from the right or left half measurement of the upper back width contour as measured on the individual. A construction line corresponding to the difference between the two measurements is then drawn between point 52 and point 104 on construction line 101, as shown. On the front of the pattern, a similar procedure is followed whereby the end of upper chest contour line C-C is established at point 102 on construction line 103.

The points 102 and 104 on upper back width contour line W-W and upper chest contour lines C-C establish a new location for the front and rear, right and left outer edges of the armholes which are located as required to account for the individual's particular measurements. The tissue paper armholes 88 may then be slashed at the base and at the chest or back width with points, as required, and moved to define the outline of an altered armhole on the pattern which includes points S, 104 and 100 on the pattern back and points S, 102 and 100 on the pattern front. The tissue paper armhole sections are then pinned or otherwise attached to the pattern and the pattern is marked using the tissue paper armholes as a guideline. The tissue paper armholes may then be removed and discarded to permit the other side of the pattern to be altered in an identical fashion.

Figure 8:
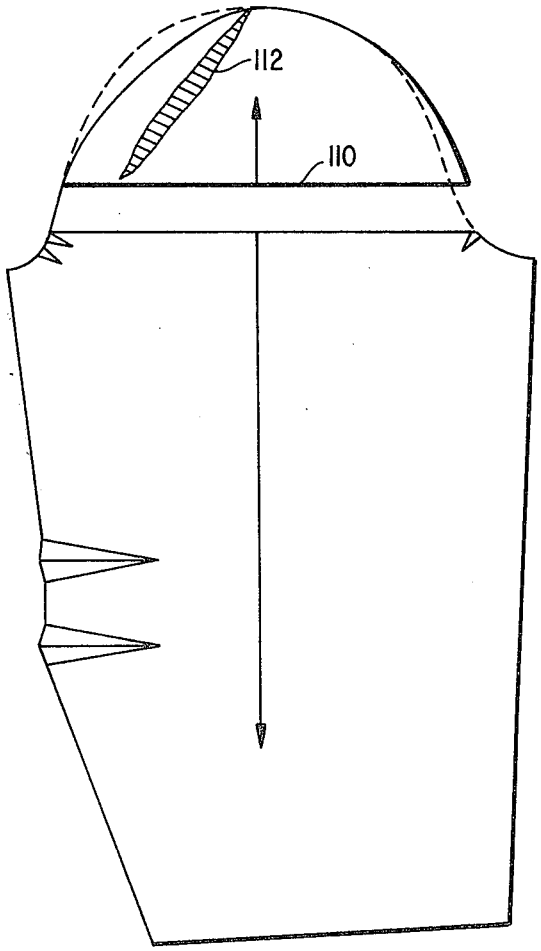
FIG. 8 shows a schematic illustration of a sleeve pattern and sleeve cap, indicating the alterations to be made to account for round or droop shouldered posture.

If the particular garment includes set-in sleeves, it will be necessary to alter the pattern for the sleeve to account for the changes in the armhole. To do this, the amounts by which the armhole has been enlarged or reduced in size from its original contour should be measured and amount equal to one-half of the sum of the alterations should be added to or removed from the sleeve pattern, evenly across the pattern as shown at 110 in FIG. 8. Where the individual to be fitted as a particular round or droop shouldered posture, some fullness will have to be eased out of the sleeve cap by folding a tuck 112 in the cap running from the top to the lower end at the back of the arm pattern.

In the method according to this invention, the front and back and right and left portions of the pattern are altered independently of each other and the differences in the patterns resulting from this independent alteration are accounted for at the side-seam by raising or lowering the armhole, according to the location of the arm-cross on the individual. This gives the corrected slope to the shoulders at the same time. Thus, the method of the invention provides a simple yet accurate way of altering garment patterns to accomodate the measurements of a particular individual.

The method and apparatus of the invention has been disclosed with regard to the alteration of a bodice front dress; however, the concept of transferring body contour lines to a pattern to facilitate pattern alteration may also be applied to other styles of garments. When first considering a different dress style, it has been found advantageous place a standard size dress of the particular style on a standard dress from of the same size, the form having been previously marked with at least one contour line parallel to the floor. In the example illustrated, the midriff contour has been used. The contour line may then be transferred to the dress by tracing through the garment, the garment side-seams having been arranged perpendicular to the floor. Using the marked standard dress, the contour line can be transferred to a pattern for the dress as a reference contour line. The shape of the contour line and amount of ease required at that contour are then noted. Knowing the amount of ease at the place where each contour line would be and knowing the shape of just one contour line on the skirt and bodice in a standard size for a given pattern, one may follow the teachings of this invention to produce properly altered patterns for most figures in any style dress.

Having described my invention in sufficient detail to enable one of ordinary skill in the art to use it, I claim:

1. A method of altering a garment pattern to suit an individual's figure, comprising the steps of:

determining on the individual the arm-cross points at which each of the individual's arms joins the body at the underarm when hanging at the individual's side;

marking the front and back portions of said garment pattern at points corresponding in location on said pattern portions to said arm-cross points on each side of the individual;

measuring an upper chest contour on the individual and establishing left and right upper side chest points thereon;

measuring an upper back contour on the individual and establishing left and right upper side back points thereon;

marking the front and back portions of said garment pattern at points corresponding in location on said pattern portions to said upper side chest and upper side back points on the individual;

marking extension lines of the side seam lines of each of said pattern portions, said extension lines extending into the pattern armholes;

marking each of said pattern portions on said extension line to define a reference point thereon at a distance above said arm-cross point corresponding on said pattern portion to the vertical distance from said arm-cross point to said upper chest or back contours on the individual;

marking a construction line on each of said pattern portions extending from said reference point toward the center of said pattern portion;

marking an upper chest contour line on said front pattern portion extending from the center front of said pattern portion through said upper side chest point and terminating with its outer end at said construction line, the length of said upper chest contour line being equal to that of the upper chest contour line measured on the individual;

marking an upper back contour line on said back pattern portion extending from the center back of said pattern portion through said upper side back point and terminating with its outer end at said construction line, the length of said upper back contour line being equal to that of the upper back contour line measured on the individual;

preparing at least one armhole template for the individual, said template having side and shoulder seam portions and front and back edge portions;

placing the side seam portion of said armhole template a distance below the arm-cross marks on each of said pattern portions to provide an allowance for ease;

placing the shoulder seam portion of said armhole template at the shoulder point of the shoulder point of each of said pattern portions; and placing said edge portions of said armhole template at the outer ends of said upper chest and back contours, thereby defining an altered armhole for said pattern.

2. A method according to claim 1, further comprising the step of:

modifying the circumferential length of said armhole template as necessary to align the front and rear edge portions thereof with said outer ends of said upper chest and back contours.

3. A method according to claim 1, wherein said construction lines are drawn at right angles to said extension lines.

* * * * *